US005368492A

United States Patent [19]

Hayashi

[11] Patent Number: 5,368,492

[45] Date of Patent: Nov. 29, 1994

[54] LEVER TYPE CONNECTOR

[75] Inventor: Hiroyuki Hayashi, Yokkaichi, Japan

[73] Assignee: Sumitomo Wiring Systems, Ltd., Yokkaichi, Japan

[21] Appl. No.: 67,137

[22] Filed: May 26, 1993

[30] Foreign Application Priority Data

Jul. 14, 1992 [JP] Japan ..... 4-49279[U]

[51] Int. Cl.[5] ..... H01R 13/62

[52] U.S. Cl. ..... 439/157; 439/372

[58] Field of Search ..... 439/152-160, 439/372

[56] References Cited

U.S. PATENT DOCUMENTS

| | | | |
|---|---|---|---|
| 2,987,693 | 6/1961 | Wamsley . | |
| 5,135,410 | 8/1992 | Kawase et al. . | |
| 5,174,785 | 12/1992 | Endo et al. | 439/157 |
| 5,178,553 | 1/1993 | Hatagishi et al. | 439/157 |
| 5,230,635 | 7/1993 | Takenouchi et al. | 439/157 |

FOREIGN PATENT DOCUMENTS

| | | | |
|---|---|---|---|
| 0459448 | 5/1991 | European Pat. Off. . | |
| 1029900 | 5/1958 | Germany . | |
| 2278674 | 11/1990 | Japan . | |
| 4133370 | 3/1991 | Japan | 439/157 |
| 2179506 | 3/1987 | United Kingdom . | |

OTHER PUBLICATIONS

English Language Abstract of Japanese Patent No. 2-278674.

*Primary Examiner*—David L. Pirlot

*Attorney, Agent, or Firm*—Sandler, Greenblum & Bernstein

[57] ABSTRACT

Protecting walls project in a certain length from an end of an opening portion of a connector to be connected with a connector. The protecting walls are opposed to a part of a lever projecting in a length of from each of sides of the lever beyond the end of the opening portion of the connector.

2 Claims, 3 Drawing Sheets

LEVER TYPE CONNECTOR

BACKGROUND OF THE INVENTION

1. Field of the Invention

The present invention relates to a lever type connector and more particularly to the lever type connector comprising a pair of connectors connected with each other by using a lever supported by a pair of shafts projecting from one of the connectors.

2. Description of the Related Arts

A great force is required to connect a plurality of connectors, for example, 20 or more with each ether. Therefore, lever type connectors have been proposed to connect them easily by means of a lever which allows an operator to connect them by applying a relatively small force thereto.

Referring to FIGS. 5 through 7, an example of the above-described conventional lever type connector is described below. A pair of supporting shafts 4 and 4 projecting from both side surfaces 1*a* and 1*a* of a connector 1 is rotatably inserted into openings 3*b* and 3*b* formed on both side surfaces of a lever 3. A pair of guide pins 5 and 5 which engage guide grooves 3*c* and 3*c* of the lever 3 project from a connector 2. The lever 3 is rotated to move the connector 2 into the connector 1 so as to connect them with each other or move the connector 2 away from the connector 1 so as to disconnect them from each other from an opening portion 1*b* of the connector 1 due to the engagement between the guide pins 5 and 5 of the connector 2 and each of the guide grooves 3*c* and 3*c* of the connector 1.

In the above-described lever type connector, as shown in FIGS. 6 and 7, both sides 3*a* and 3*a* integral with the lever 3 are projected forward therefrom in a length (a) beyond the forward end 1*c* of the connector 1 in consideration of the configuration of the forward end 3*d* (refer to FIG. 5) of the guide groove 3*c*.

The above-described lever type connector has, however, the following problem in installing it on an automobile or the like: As shown in FIG. 6, both sides 3*a* and 3*a* of the lever 3 are projected forward in the length beyond the forward end 1*c* of the connector 1 as described above. Therefore, when an external force is applied to the connector 1 in a direction shown by an arrow (A), the side 3*a* is opened outward as shown by two-dot chain lines of FIG. 6. As a result, the shaft 4 disengages from the opening 3*b* and hence, the lever 3 falls away from the connector 1.

SUMMARY OF THE INVENTION

It is an object of the present invention to provide a lever type connector, comprising a pair of connectors connected with each other by using a lever, capable of preventing a lever from being removed from one of the connectors.

In accomplishing this and other objects, there is provided a lever type connector, comprising: a pair of a first connector and a second connector to be connected with each other, in which a pair of supporting shafts formed on each side surface of the first connector is rotatably inserted into a pair of openings formed on each side of a lever; and a pair of guide pins engaging each of a pair of guide grooves formed on the lever project from the second connector. In this construction, from an opening portion of the first connector, the lever is rotated to move the second connector into the first connector so as to connect the first and second connectors with each other or move the second connector away from the first connector so as to disconnect the first and second connectors from each other due to the engagement between the guide pins and the guide grooves. A pair of protecting walls, integral with the first connector, projects in a certain length from an end of the opening portion of the first connector in such a manner that each of the protecting walls is opposed to each of a pair of portions of the lever projecting from each side thereof beyond the end of the opening portion of the first connector.

According to the above-described construction, a pair of the protecting walls project in a certain length from the end of the opening portion of the first connector in such a manner that each of the protecting walls is opposed to each of a pair of the portions of the lever projecting from each side of the lever beyond the end of the opening portion of the first connector. The protecting walls protect the portions of the lever projecting from each side of the lever beyond the end of the opening portion of the first connector and thus prevent an external force from applying to both sides of the lever. Therefore, the lever can be prevented from falling away from the first connector, which facilitates an operation for connecting the first and second connectors with each other. This construction allows the manufacturing cost of the lever type connector to be inexpensive because only the protecting wall integral with the first connector is projected.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
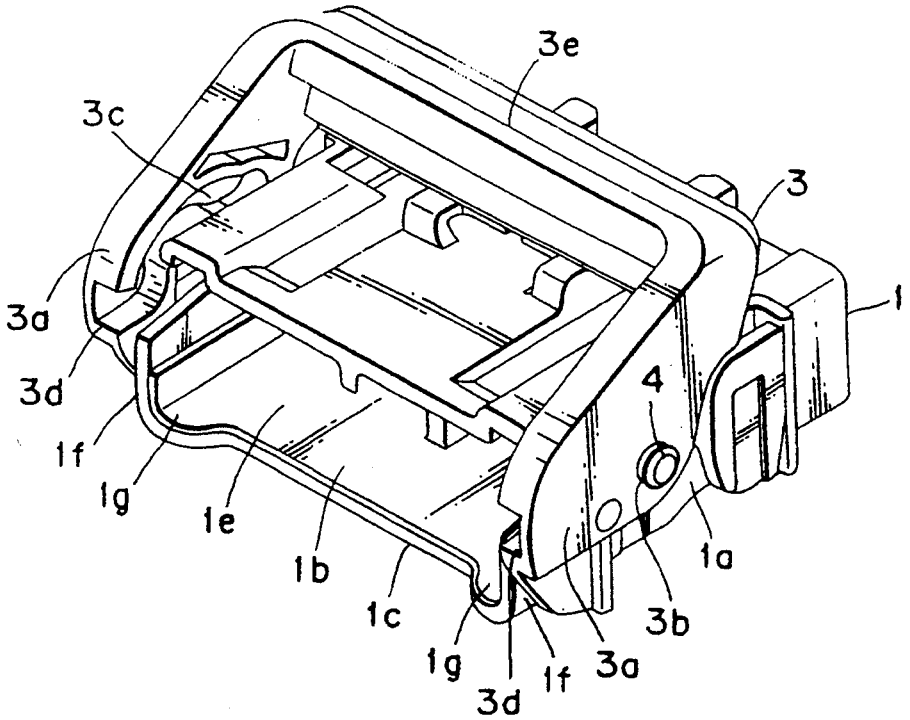
FIG. 1 is a perspective view showing a lever type connector according to an embodiment of the present invention.

Before the description of the present invention proceeds, it is to be noted that like parts are designated by like reference numerals throughout the accompanying drawings.

Referring to the drawings, a lever type connector according to an embodiment of the present invention will be described below.

Figure 2:
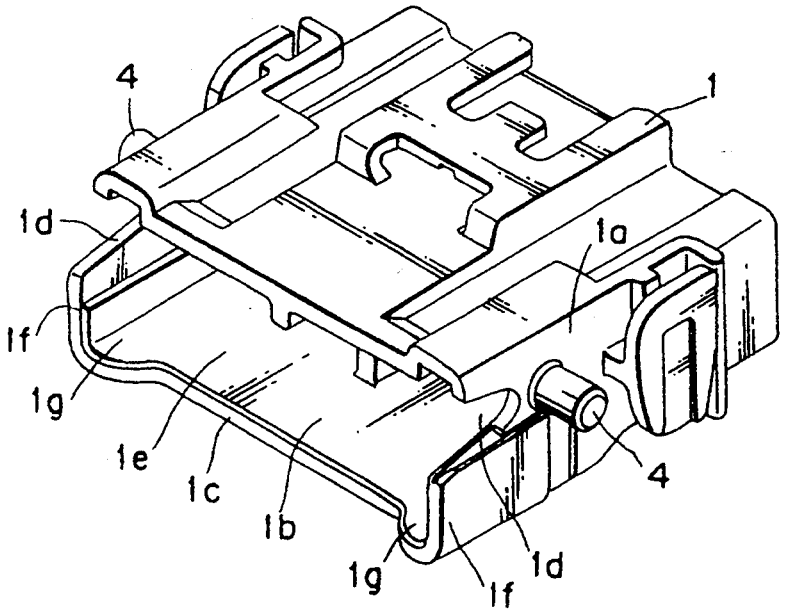
FIG. 2 is a perspective view showing a female connector of the lever type connector shown in FIG. 1.
Figure 5:
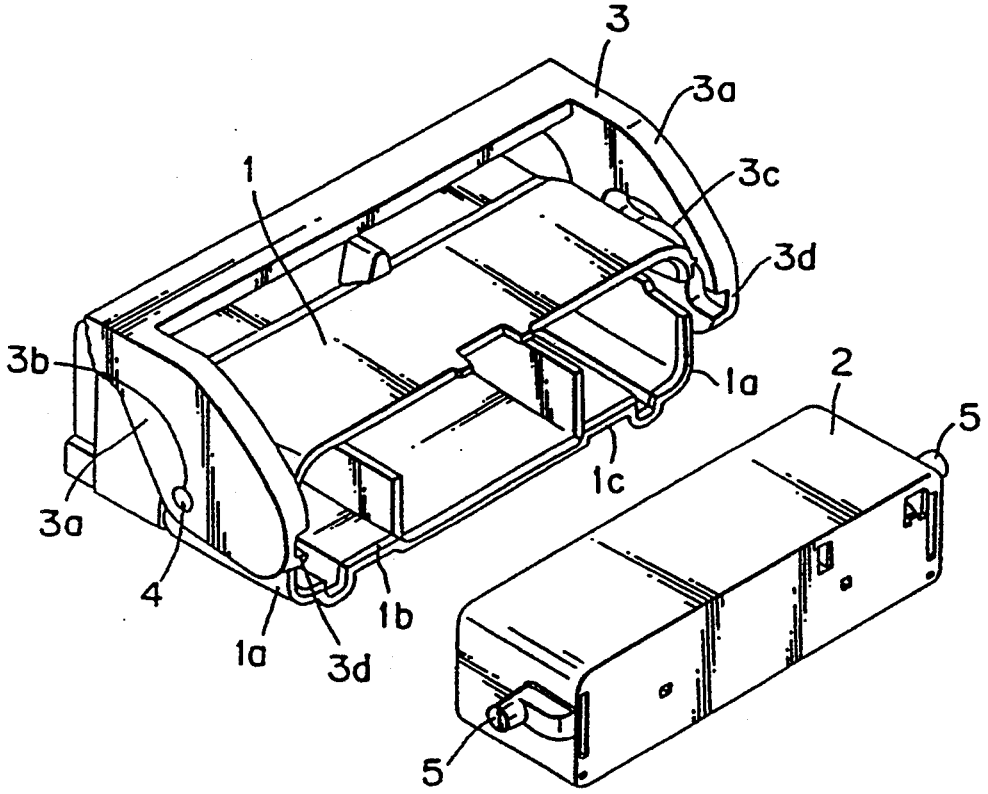
Fig. 5 PRIOR ART
FIG. 5 is a perspective view showing a conventional lever type connector.

As shown in FIGS. 1 and 2, the lever type connector comprises a female connector 1 on which a lever 3 has been mounted. The female connector 1 is a multipolar connector having a plurality of terminal-accommodating chambers (not shown) arranged in parallel with each other. A male connector 2 (refer to FIG. 5) is inserted into the female connector 1 from an opening portion 1*b* thereof from the forward end of the opening portion 1*b* so as to connect the male connector 2 with the female connector 1.

The lever 3 comprises a pair of sides 3*a* and 3*a;* and a connecting portion 3*e* which connects the sides 3*a* and 3*a* with each other. A pair of supporting shafts 4 and integral with the female connector 1, projecting outward from the outer surfaces of a pair of side surfaces 1*a* and 1*a* of the female connector 1 is inserted into each of a pair of openings 3*b* and 3*b* formed on the sides 3*a* and 3*a* so that the lever 3 is rotatably supported on the female connector 1 by means of the supporting shafts 4 and 4.

The lever 3 has on the inner surfaces of both sides 3*a* and 3*a* thereof a pair of guide grooves 3*c* and 3*c,* in a circular arc configuration, which are engaged by each of a pair of guide pins 5 and 5 (refer to FIG. 5) of the male connector 2.

The female connector 1 has on both sides 1*a* and 1*a* thereof a pair of guide grooves 1*d* and 1*d* formed inward from the forward end 1*c* of the opening portion 1*b*. The guide pins 5 and 5 of the male connector 2 engage each of the grooves 1*d* and 1*d* so that the guide pins 5 and 5 move the male connector 2 into and out of the female connector 1 linearly.

Figure 3:
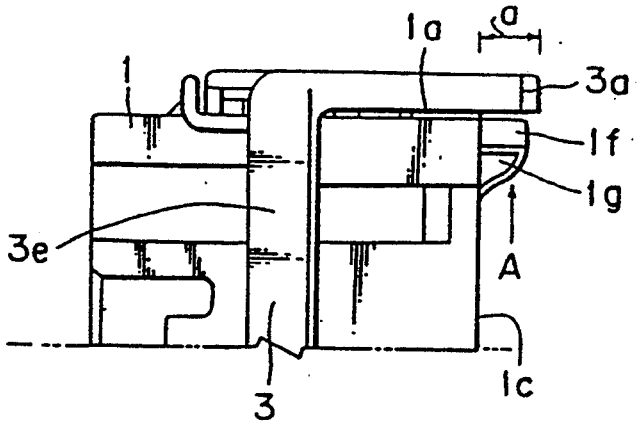
FIG. 3 is a plan view showing the relationship between a lever and a protecting wall of the female connector.

The sides 3*a* and 3*a* integral with the lever 3 are projected therefrom 3 in a length (a) beyond the forward end 1*c* of the female connector 1 in consideration of the configuration of the forward end 3*d* of the guide groove 3*c* as shown in FIG. 3. A pair of protecting side walls 1*f* and 1*f* integral with the female connector 1 are projected in a certain length beyond the forward end 1*c* of the opening portion 1*b*. The protecting side walls 1*f* and 1*f* are disposed below the opening portion 1*b* and opposed to the projected portion, the length of which is (a) as described above. There are formed, on both sides of the bottom surface 1*e* of the female connector 1, a pair of protecting bottom walls 1*g* and 1*g* integral with each of the protecting side walls 1*f* and 1*f*.

Figure 4:
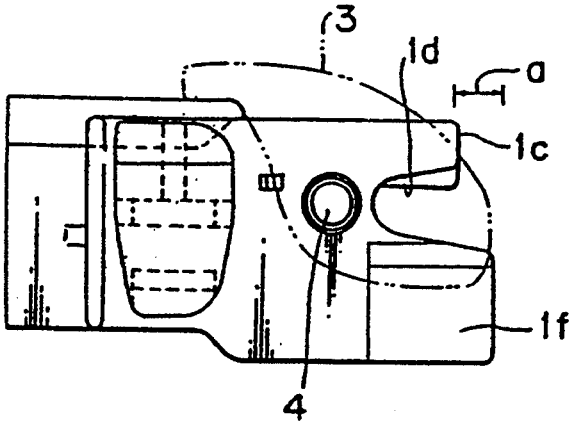
FIG. 4 is a side elevational view showing the lever and the protecting wall of the female connector shown in FIG. 3.
Figure 6:
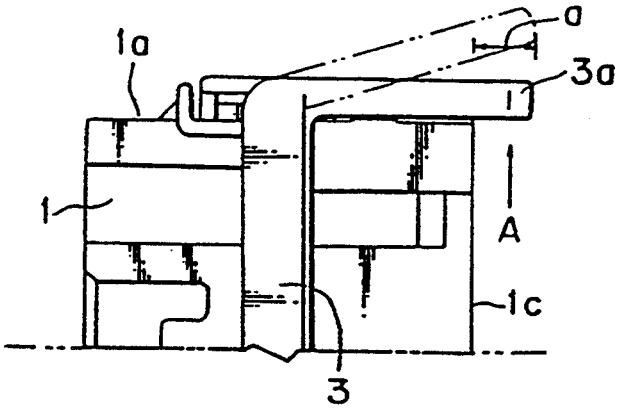
Fig. 6 PRIOR ART
FIG. 6 is a plan view showing the relationship between a lever and female connector of a conventional lever type connector.
Figure 7:
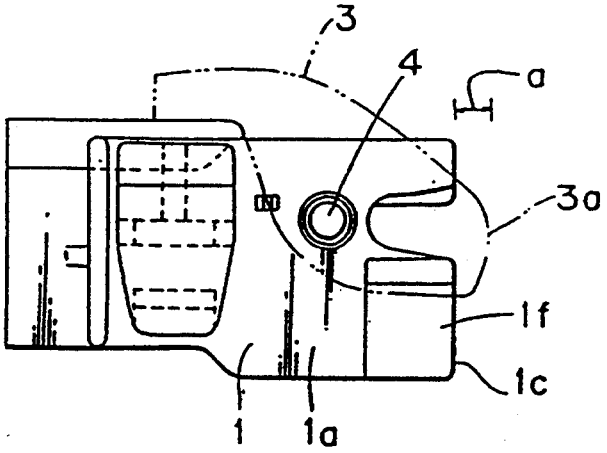
Fig. 7 PRIOR ART
FIG. 7 is a side elevational view showing the conventional lever type connector shown in FIG. 5.

In installing the lever type connector having the above-described construction on an automobile or the like, with the supporting shafts 4 and 4 of the female connector 1 inserted into each of the openings 3*b* and 3*b* of the lever 3 so as to rotatably support the lever 3 on the female connector 1 by means of the shafts 4 and 4, an external force applied to the female connector 1 in the direction shown by the arrow (A) as shown in FIGS. 3 and 4 does not act on the side 3*a* but on the protecting side wall 1*f* of the female connector 1 or the protecting side wall 1*g* thereof. Consequently, the side 3*a* is not opened outward and thus the opening 3*b* can be prevented from being disengaged from the supporting shaft 4. That is, the lever 3 can be prevented from falling away from the female connector 1.

Although the present invention has been fully described in connection with the preferred embodiments thereof in the accompanying drawings, it is to be noted that various changes and modifications are apparent to those skilled in the. art. Such changes and modifications are to be understood as included within the scope of the present invention as defined by the appended claims,unless they depart therefrom.

What is claimed is:

1. A lever type connector comprising:

a first connector and a second connector adapted to be connected with each other, a pair of supporting shafts being formed on respective side surfaces of the first connector, said pair of supporting shafts being rotatably inserted into a pair of openings formed on respective sides of a lever; and a pair of guide pins engaging each of a pair of guide grooves formed on the lever, said pair of guide pins projecting from the second connector, whereby, from an opening portion of the first connector, the lever is rotated to move the second connector into the first connector so as to connect the first and second connectors with each other, or move the second connector away from the first connector so as to disconnect the first and second connectors from each other due to the engagement between the guide pins and the guide grooves; the opening portion being on said respective opposed side surfaces of the first connector, each respective side surface having an upper portion above the opening portion and a lower portion below the opening portion, and a pair of protecting walls, said pair of protecting walls being integral with the lower portion of the first connector and projecting in a predetermined length from an end of the opening portion of the first connector in such a manner that each of the protecting walls is opposed to each of a pair of portions of the lever projecting from each side thereof beyond the end of the opening portion of the first connector, wherein the respective protecting walls project beyond the respective upper portions, and whereby the protecting walls protect the portions of the lever projecting from each side of the lever beyond the end of the opening portion of the first connector and thus prevent an external force from being applied to both sides of the lever.

2. A lever type connector, comprising:

a first connector and a second connector adapted to be connected with each other, a pair of supporting shafts being formed on respective side surfaces of the first connector, said pair of supporting shafts being rotatably inserted into a pair of openings formed on respective sides of a lever; a pair of guide pins engaging each of a pair of guide grooves formed on the lever, said pair of guide pins projecting from the second connector, wherein from an opening portion of the first connector, the lever is rotated to move the second connector into the first connector so as to connect the first and second connectors with each other, or move the second connector away from the first connector so as to disconnect the first and second connectors from each other due to the engagement between the guide pins and the guide grooves; the opening portion being on said respective opposed side surfaces of the first connector, each respective side surface having an upper portion above the opening portion and a lower portion below the opening portion, and a pair of protecting walls, said pair of protecting walls being integral with the lower portion of the first connector, and projecting in a predetermined length from an end of the opening portion of the first connector in such a manner that each of the protecting walls is opposed to each of a pair of portions of the lever projecting from each side thereof beyond the end of the opening portion of the first connector, wherein the respective protecting walls project beyond the respective upper portions.

* * * * *